US006796266B1

(12) United States Patent
Castillo

(10) Patent No.: US 6,796,266 B1
(45) Date of Patent: Sep. 28, 2004

(54) MARKER DEVICE

(76) Inventor: Michael J. Castillo, 9362 Los Torres Dr, Elk Grove, CA (US) 95624

( * ) Notice: Subject to any disclaimer, the term of this patent is extended or adjusted under 35 U.S.C. 154(b) by 0 days.

(21) Appl. No.: 10/269,518

(22) Filed: Oct. 11, 2002

(51) Int. Cl.[7] ..... B42D 9/00

(52) U.S. Cl. ..... 116/234; 116/235; 116/240; 273/240

(58) Field of Search ..... 116/234–237, 240; 281/42; D19/34; 428/201–204, 913.3; 273/240

(56) References Cited

U.S. PATENT DOCUMENTS

| | | | | | |
|---|---|---|---|---|---|
| 922,110 | A | * | 5/1909 | Eberle | 116/238 |
| 1,802,081 | A | * | 4/1931 | Kelly | 281/42 |
| 1,966,340 | A | | 7/1934 | Forbringer et al. | |
| 2,001,650 | A | | 5/1935 | Bane | |
| D114,521 | S | * | 4/1939 | Nierenberg | D19/34 |
| 2,543,182 | A | * | 2/1951 | Lang | 116/235 |
| 3,512,273 | A | * | 5/1970 | Baker, Jr. et al. | 434/163 |
| 4,041,892 | A | | 8/1977 | Nichols | |
| 4,569,538 | A | | 2/1986 | Kurschner | |
| 4,850,595 | A | * | 7/1989 | Sherman et al. | 273/240 |
| 4,901,665 | A | * | 2/1990 | Carlin | 116/235 |
| 5,377,612 | A | * | 1/1995 | Catalano et al. | 116/234 |
| 5,443,029 | A | * | 8/1995 | Garnet | 116/235 |
| 5,458,081 | A | * | 10/1995 | Reichert | 116/234 |
| 5,577,459 | A | | 11/1996 | Alden | |
| 5,762,339 | A | * | 6/1998 | Olson | 273/269 |
| D410,679 | S | | 6/1999 | Blanchard et al. | |
| 5,989,033 | A | * | 11/1999 | Burgio | 434/88 |
| 6,352,048 | B1 | * | 3/2002 | Scott | 116/238 |
| 6,481,127 | B1 | * | 11/2002 | Bilbie et al. | 40/299.01 |

* cited by examiner

*Primary Examiner*—Christopher W. Fulton
*Assistant Examiner*—Tania Courson

(57) ABSTRACT

A marker device for to a user the location in a piece of literature where the user was previously reading. The marker device includes a panel member for positioning between pages of literature. The panel member has a front side and a back side. A front surface of the front side has indicia thereon. The panel member has a top end and a bottom end.

A marking membrane for producing markings on the front side of the panel member is releasably positionable on the front side of the panel member.

The markings are producible on the panel member adjacent to the appropriate indicia relating to positions on the pages of the literature when the marking membrane is depressed against the front surface of the panel member, and deletable when the marking membrane is separated from the panel member.

1 Claim, 3 Drawing Sheets

MARKER DEVICE

BACKGROUND OF THE INVENTION

1. Field of the Invention

The present invention relates to bookmarkers and more particularly pertains to a new marker device for indicating to a user the location in a piece of literature where the user was previously reading.

2. Description of the Prior Art

The use of bookmarkers is known in the prior art. U.S. Pat. No. 4,569,528 describes a bookmark with a retaining hook element at the top thereof to receiver the upper end of the bound edge of a book. Another type of bookmarker is U.S. Pat. No. 5,577,459 which discloses the details of a page and paragraph indicating bookmark.

While these devices fulfill their respective, particular objectives and requirements, the need remains for a device fully indicates the exact location of where in the literature, be it a book, a magazine, a newspaper or the like, the user last left off reading.

SUMMARY OF THE INVENTION

The present invention meets the needs presented above by incorporating a plurality of indicia each corresponding to page sides, columns, paragraphs, and even line numbers, and a means of quickly and easily marking these indicators repeatedly.

Still yet another object of the present invention is to provide a new marker device that permits the user to make indicator marks on the front of the marker device, and easily delete them by simply lifting up a marking membrane coupled to the front surface of the device.

Even still another object of the present invention is to provide a new marker device that includes a marking member to facilitate making the markings that is attached to an end of a tassel member which serves to more easily locate the marker when it is positioned in the literature.

To this end, the present invention generally comprises a panel member for positioning between pages of literature. The panel member has a front side and a back side. A front surface of the front side has indicia thereon. The panel member has a top end and a bottom end.

A marking membrane for producing markings on the front side of the panel member is releasably positionable on the front side of the panel member.

The markings are producible on the panel member adjacent to the appropriate indicia relating to positions on the pages of the literature when the marking membrane is depressed against the front surface of the panel member, and deletable when the marking membrane is separated from the panel member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
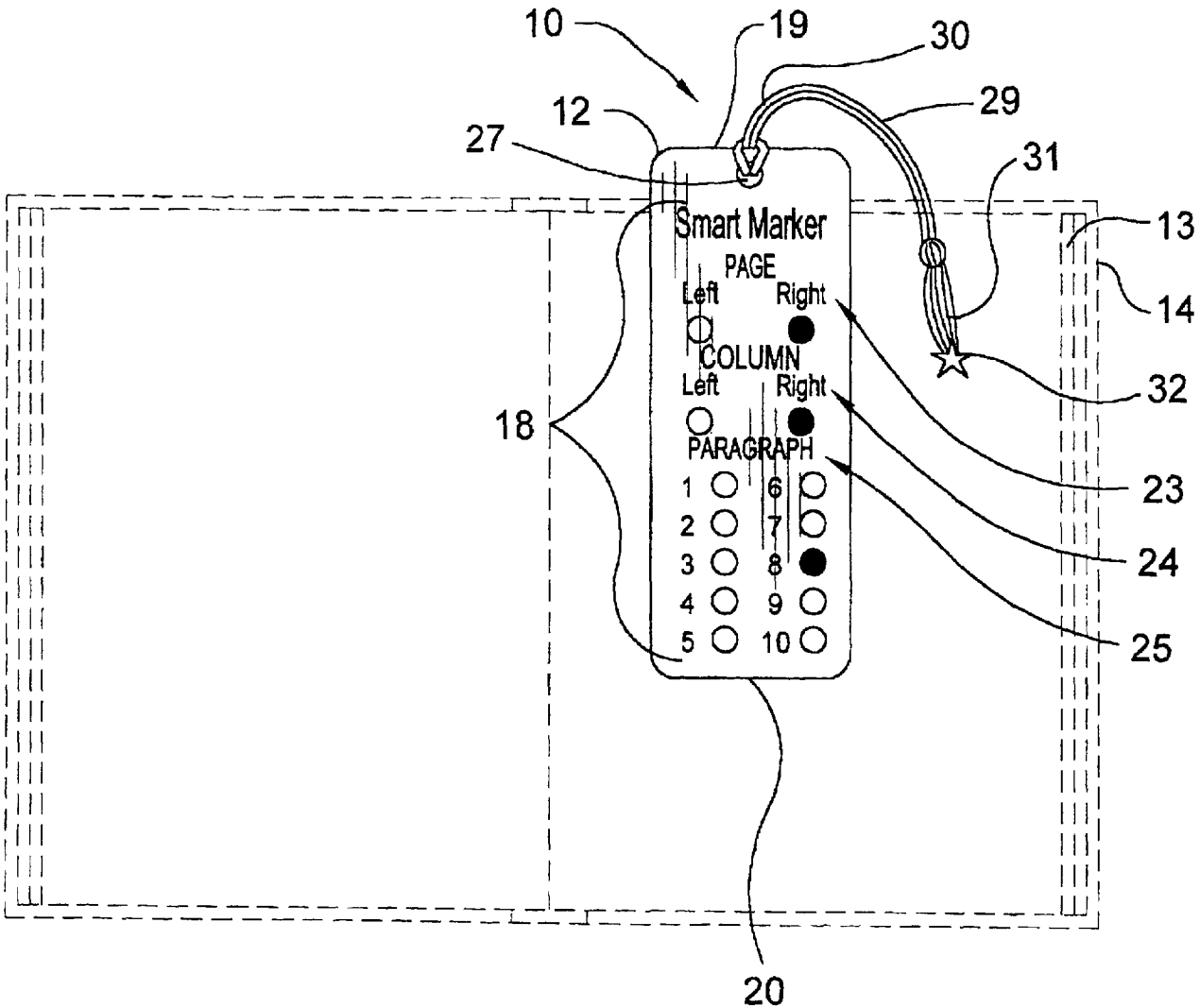
FIG. 1 is a schematic front view of a new marker device according to the present invention.
Figure 2:
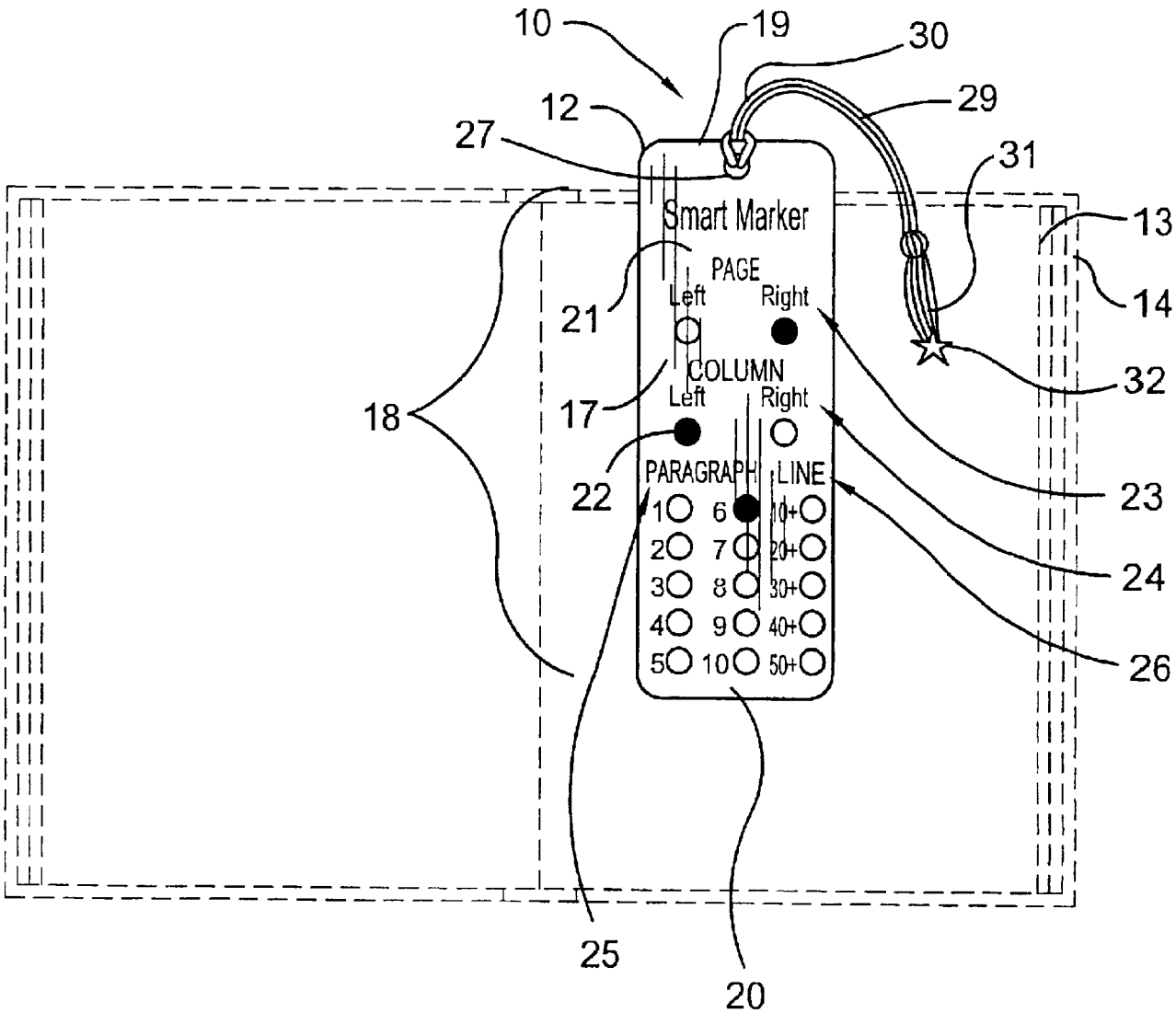
FIG. 2 is a schematic front view of an alternate embodiment of the present invention.
Figure 3:
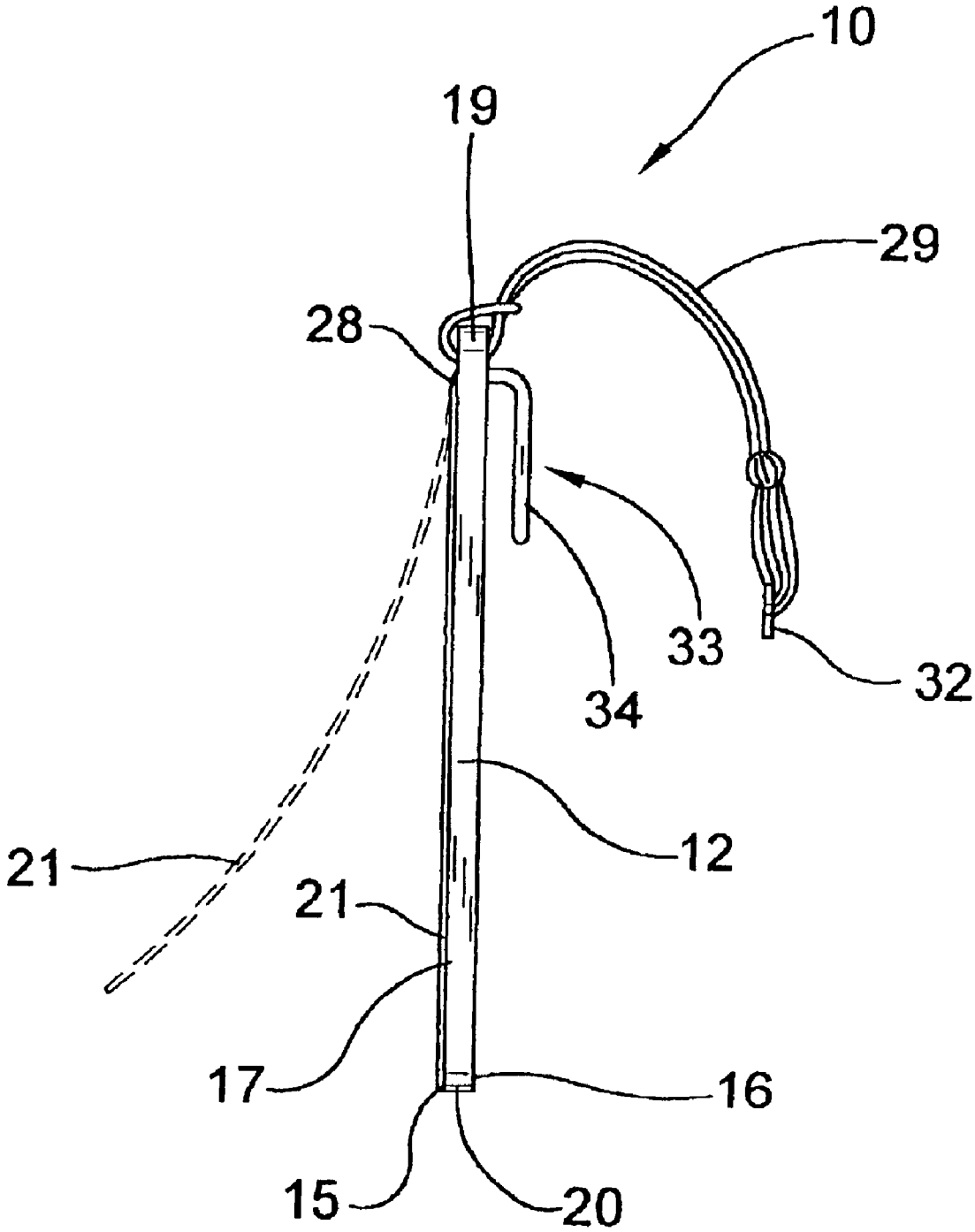
FIG. 3 is a schematic side view of the present invention.

With reference now to the drawings, and in particular to FIGS. 1 through 3 thereof, a new marker device embodying the principles and concepts of the present invention and generally designated by the reference numeral 10 will be described.

As best illustrated in FIGS. 1 through 3, the marker device 10 generally comprises a panel member 12 for positioning between pages 13 of literature 14. The panel member 12 has a front side 15 and a back side 16. A front surface 17 of the front side 15 has indicia 18 thereon. The panel member 12 has a top end 19 and a bottom end 20.

A marking membrane 21 for producing markings 22 on the front side 15 of the panel member 12 is releasably positionable on the front side 15 of the panel member 12.

The markings 22 are producible on the panel member 12 when the marking membrane 21 is depressed against the front surface 17 of the panel member 12, and deletable when the marking membrane 21 is separated from the panel member 12.

The panel member 12 is generally flat and has a generally rectangular shape. The indicia 18 of the panel member 12 include page indicators 23, column indicators 24, and paragraph indicators 25.

In one embodiment of the invention as shown in FIG. 2, the indicia 18 of the panel member 12 may also include line indicators 26.

A specific location in the literature 14 is identifiable by a user when a selected number of the markings 22 are produced adjacent to the indicia 18 to indicate where in the literature 14 the user stopped reading.

The top end 19 of the panel member 12 has a hole 27 extending therethrough.

The front surface 17 of the panel member 12 comprises a generally tacky material such that the marking membrane 21 is releasably adherable to the front surface 17 when the user selectively depresses the marking membrane 21 against the front surface 17.

An upper edge 28 of the marking membrane 21 is attached to the top end 19 of the front side 15 of the panel member 12 such that the marking membrane 21 remains positioned generally atop the front side 15 of the panel member 12.

The marking membrane 21 has length and width dimensions substantially equal to length and width dimensions of the front surface of the panel member 1.

The marking membrane 21 has length and widht dimensions substantially equal to length and width dimensions of the front surface of the panel member 12. The marking membrane 21 comprises a flexible plastic material, and is substantially transparent.

An elongate tassel member 29 facilitates the location of the panel member 12 when the panel member 12 is positioned in the literature 14.

The tassel member 29 has a first end 30 and a second end 31. The first end 30 is releasably attachable to the top end 19 of the panel member 12 through the hole 27.

The second end 31 of the tassel member 29 has a marking member 32 disposed thereon for facilitating the production of the markings 22 on the panel member 12.

An attachment member 33 for selectively coupling the panel member 12 to an object. The attachment member 33 is fixedly coupled to the back side 16 of the panel member 12.

The attachment member 33 comprises an L-shaped clip 34 and is positioned generally adjacent to the hole 27 in the panel member 12.

The attachment member 33 enables the user to selectively attach the panel member 12 to an object for storage while reading, or to pages 13 of the literature 14 to secure the panel member 12 to the literature 14.

In use, the user notes which side of the literature 14 he is currently on, either left or right, what column if applicable, what paragraph, and approximately what line number, to be remembered. The user then utilizes the marking member 32, or any solid object for that matter, to make the appropriate markings 22 adjacent to the corresponding indicia 18 to indicate where to return to when reading is begun again. The panel member 12 is then placed between the pages 13 presently at and closes the literature 14 with the tassel protruding out.

Upon returning to continue reading, the user locates the panel member 12 and the place where he left off. The markings 22 are cleared by pulling the marking membrane 21 away from the top surface of the panel, leaving it ready for the next use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications arid changes will readily occur to those skilled in the art, it is not desired to limit the invention to the exact construction and operation shown and described, and accordingly, all suitable modifications and equivalents may be resorted to, falling within the scope of the invention.

What is claimed is:

1. A marker device for indicating to a user the location in a piece of literature where the user was previously reading, said marker device comprising:

a panel member for positioning between pages of literature, said panel member having a front side and a back side, a front surface of said front side having indicia thereon, said panel member having a top end and a bottom end;

a marking membrane for producing markings on said front side of said panel member, said marking membrane being releasably positionable on said front side of said panel member;

wherein said markings are producible on said panel member when said marking membrane is depressed against said front surface of said panel member and deletable when said marking membrane is separated from said panel member;

said panel member being generally flat and having a generally rectangular shape, said indicia of said panel member including page indicators, column indicators, and paragraph indicators;

wherein said indicia of said panel member also includes line indicators;

wherein a specific location in the literature is identifiable by a user when a selected number of said markings are produced adjacent to said indicia to indicate where in the literature the user stopped reading;

said top end of said panel member having a hole extending therethrough;

said front surface of said panel member comprising a generally tacky material such that said marking membrane is releasably adherable to said front surface when the user selectively depresses said marking membrane against said front surface;

an upper edge of said marking membrane being attached to said top end of said front side of said panel member such that said marking membrane remains positioned generally atop said front side of said panel member;

said marking membrane having length and width dimensions substanitially equal to length and width dimensions of said front surface of said panal member;

said marking membrane having length and width dimensions substantially equal to length and width dimensions of said front surface of said panel member;

an elongate tassel member for locating said panel member when positioned in the literature;

said tassel member having a first end and a second end, said first end being releasably attachable to said top end of said panel member through said hole;

said second end of said tassel member having a marking member disposed thereon for facilitating the production of said markings on said panel member;

an attachment member for selectively coupling said panel member to an object, said attachment member being fixedly coupled to said back side of said panel member;

said attachment member comprising an L-shaped clip and being positioned generally adjacent to said hole in said panel member; and wherein said attachment member enables the user to selectively attach said panel member to an object for storage while reading, or to pages of the literature to secure said panel member to the literature.

* * * * *